US005269167A

United States Patent [19]

Gerhart

[11] Patent Number: 5,269,167

[45] Date of Patent: Dec. 14, 1993

[54] UNIVERSAL AERIAL CAM UNIT

[75] Inventor: Roland T. Gerhart, Milford, Mich.

[73] Assignee: Connell Limited Partnership, Boston, Mass.

[21] Appl. No.: 819,347

[22] Filed: Jan. 9, 1992

[51] Int. Cl.[5] ..... B21D 5/04

[52] U.S. Cl. ..... 72/381; 72/304; 72/452; 72/315; 83/635

[58] Field of Search ..... 72/313, 314, 315, 304, 72/301, 303, 452; 83/588, 627, 635

[56] References Cited

U.S. PATENT DOCUMENTS

| | | | |
|---|---|---|---|
| 4,044,592 | 8/1977 | Carrieri et al. | 72/462 |
| 4,139,090 | 2/1979 | Nelson | 198/740 |
| 4,259,052 | 3/1981 | Imanishi et al. | 72/405 |
| 4,323,151 | 4/1982 | Andrews | 198/740 |
| 4,436,199 | 3/1984 | Baba et al. | 198/750 |
| 4,471,644 | 9/1984 | Kimbell et al. | 72/405 |
| 4,471,680 | 9/1984 | Gerhart | 83/588 |
| 4,487,051 | 12/1984 | Iwamoto | 72/315 |
| 4,887,446 | 12/1989 | Maher | 72/22 |
| 5,003,808 | 4/1991 | Maher | 72/405 |
| 5,101,705 | 4/1992 | Matsuoka | 72/452 |

FOREIGN PATENT DOCUMENTS

| | | | |
|---|---|---|---|
| 0202924 | 11/1983 | Japan | 72/452 |
| 087933 | 5/1984 | Japan | 72/315 |
| 0193723 | 11/1984 | Japan | 72/451 |
| 0137530 | 7/1985 | Japan | 72/315 |
| 0263824 | 11/1987 | Japan | 72/313 |

*Primary Examiner*—David Jones
*Attorney, Agent, or Firm*—Leydig, Voit & Mayer

[57] ABSTRACT

An adjustable aerial cam unit for use in a power press comprising a stationary driver assembly coupled to the press bed, a slide block to which the working tool is mounted, and means for coupling the slide block to the ram of the power press for movement therewith. The slide block is slidably mounted at an angle relative to the plane of movement of the ram to move between extended and retracted positions. The slide block includes a lower inclined bearing surface and the driver assembly an upper inclined bearing surface, so that when the pressure pad and the ram are lowered, the slide block will abut the driver assembly, and the inclined bearing surfaces slide against each other. As the ram motion continues, the slide block moves from the extended to the retracted position with respect to the ram. The movement of the slide block at an angle to the plane of movement of the ram results in a corresponding component of movement transverse to the plane of movement of the ram and a component of movement in a plane parallel to the plane of movement of the ram to bring the tool into engagement with a workpiece disposed between the pressure pad unit and the lower die to perform a desired operation. According to an aspect of the invention, the components of the aerial cam unit may be disassembled and selectively replaced, so that the unit may be adapted for use in a desired application.

24 Claims, 15 Drawing Sheets

UNIVERSAL AERIAL CAM UNIT

FIELD OF THE INVENTION

This invention relates generally to power press assemblies, and, more particularly, to aerial cam units for use in power press assemblies.

BACKGROUND OF THE INVENTION

In the metalworking industry, power presses are often used to form stock material such as steel or sheet metal into a variety of components. For example, in the automotive industry, sheet stock is formed into components of relatively small parts, such as engine struts, as well as significantly larger vehicle body components, such as deck lids, doors, and quarter panels.

Typically, the workpiece is drawn or struck one or more times between upper and lower die halves to form the stock into a desired shape. Due to the particular shape of the article, in many applications, it is necessary to perform an operation on the workpiece at an angle other than with the travel of the press. For example, it may be necessary to punch an opening into or trim flash from the edge of the workpiece. In such situations, the workpiece may be reoriented and/or advanced to another workstation to perform the required operation. Alternately, a separate device may be provided within the particular workstation. Such devices may be actuated once the drawing has been completed, or, alternately, simultaneously with the drawing operation.

Particularly effective devices for performing such auxiliary operations are "aerial cam" units. Aerial cam units are generally associated with the ram of the press. Thus, the cam unit does not interfere with movement of a workpiece through the press as it is suspended above the working area when the press is open.

While various aerial cam devices have been developed, an aerial cam unit is generally unique to the die set, part, and press for which it has been designed. Thus, when the die set or part is changed on a press, the aerial cam unit must likewise be changed. Consequently, an aerial cam unit must be provided for each die set or part utilized in a particular press. The design and construction of unique aerial cam units for use with the various die sets or parts utilized in a particular press is both costly and time consuming. Further, aerial cam units are generally quite large, cumbersome, and heavy. Thus, replacing the unit can be difficult and time consuming, resulting in excessive downtime, high labor costs, and high maintenance costs.

OBJECTS OF THE INVENTION

It is a general object of the invention to provide a universal aerial cam unit which standardizes the design of such aerial cam units utilized in power presses and thereby reduce the costs attendant with the design and construction of unique aerial cam units for each die set. It is an additional object to provide a standard aerial cam unit design that may be adapted for use with more than a single die set.

Another object is to reduce downtime, labor costs, and maintenance costs associated with die and aerial cam changes and adjustments. It is a related object to provide an aerial cam unit that may be easily and quickly removed from a press, and assembled and disassembled both inside and outside of the press. It is a more specific object to provide an aerial cam unit that is smaller, lighter, and less cumbersome than traditional units. It is a further object to provide an aerial cam unit that may be adjusted to account for wear.

BRIEF SUMMARY OF THE INVENTION

In accomplishing these objectives, an adjustable aerial cam unit is provided for a power press having a press bed, a ram, which is movable with respect to the press bed and a pressure pad unit, which is movable with respect to the press bed and the ram. During operation, as the pressure pad lowers toward the press bed, a workpiece is held or formed into a desired part between a lower die and the upper pressure pad unit of the die. The aerial cam unit includes a stationary driver, which is mounted to the press bed, a slide block to which the working tool is mounted, and means for slidably coupling the slide block to the ram for movement with the ram. The slide block is slidably mounted at an angle to the plane of movement of the ram to move relative to the ram between an extended position, when the slide block is at the greatest distance from the ram, and a retracted position, when the slide block is disposed near to the ram. The driver includes an upper inclined bearing surface, and the slide block includes a parallel lower inclined bearing surface. At the initiation of a press cycle, the pressure pad unit and the ram are in their open position in the press, and the slide block is disposed in its extended position. As the pressure pad moves to close the die, it dwells, the ram lowers, and the slide block is likewise moved toward the driver. As the ram moves, the lower inclined surface of the slide block seats on the upper inclined surface of the driver. As the downward motion of the ram continues, the slide block moves upward with respect to the ram, moving from the extended to the retracted position. Because the slide block is slidably mounted at an angle to the plane of motion of the ram, the movement of the slide block with respect to the ram in the plane of motion of the ram results in a corresponding component of movement transverse to the plane of motion of the ram as the slide block slides downward on the driver. This transverse movement component of the slide block moves the working tool into engagement with the workpiece to perform a desired operation. It will be appreciated, however, that the unit is preferably mounted such that the travel of the slide block results in the tool engaging the workpiece at a substantially perpendicular angle.

According to an important aspect of the invention, the aerial cam unit is comprised of various components that may be adjusted to modify the design of the unit. Further, the unit may be adapted for use in multiples. Consequently, the standardized unit may be adapted for use with substantially any die set.

Further, the aerial cam unit may be easily assembled and disassembled, both inside and out of the press. It is preferably lighter, smaller, and less cumbersome than traditional units. Thus, maintenance functions, such as adjusting the unit to account for wear, may be readily performed in the shop. As a result, labor and maintenance costs, as well as down time are substantially reduced.

These and other features and advantages of the invention will be more readily apparent upon reading the following description of a preferred exemplified embodiment of the invention and upon reference to the accompanying drawings wherein:

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DESCRIPTION OF THE PREFERRED EMBODIMENT

Figure 1:
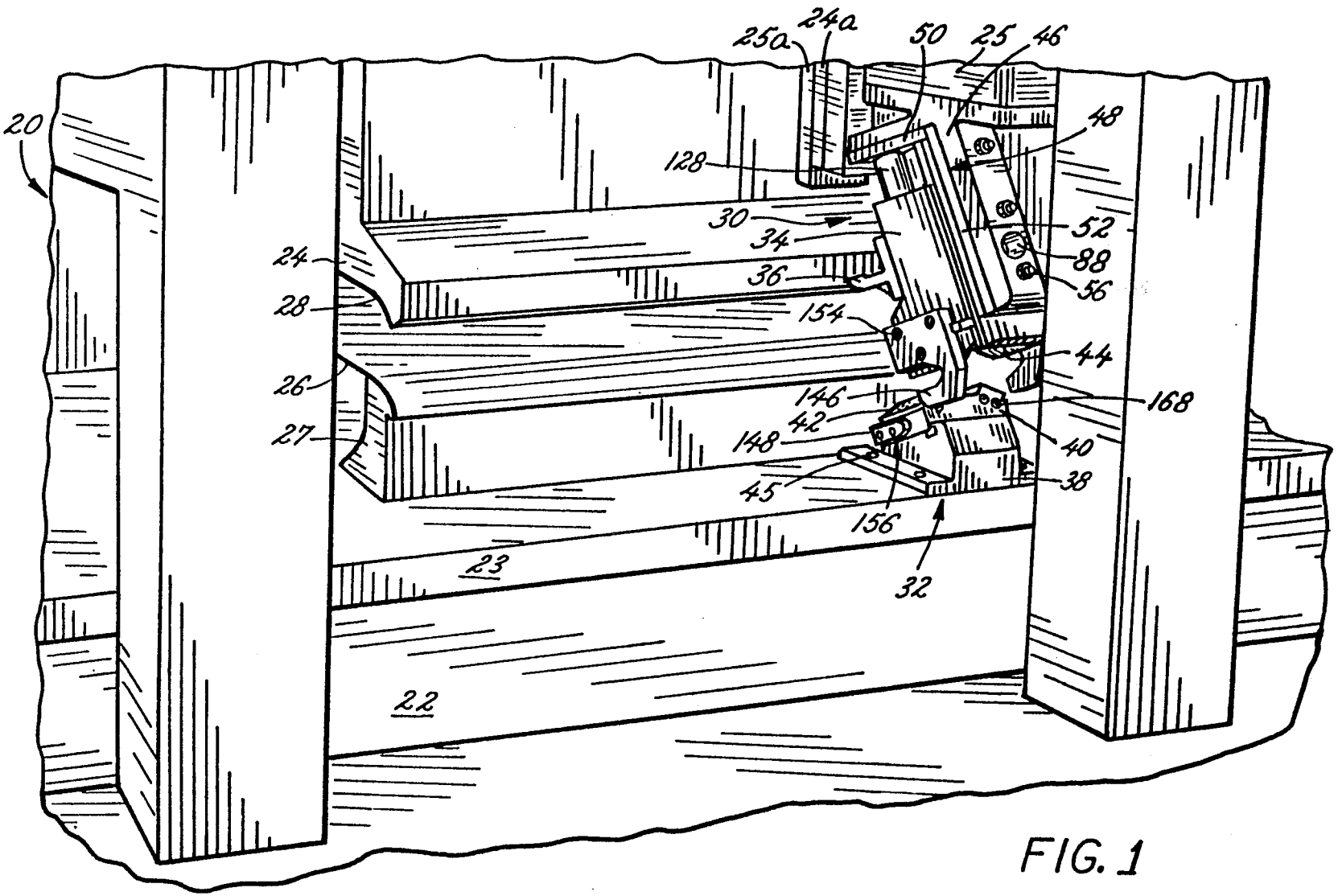
FIG. 1 is a fragmentary perspective view of a power press incorporating an aerial cam assembly constructed according to the present invention.

Turning now to the drawings, there is shown in FIG. 1 a fragmentary view of a power press 20 used for the deformation of material such as steel into a desired part or parts. The power press 20 includes a stationary press bed 22 to which is coupled a lower die shoe or bolster plate 23. Along its upper portion, the power press 20 includes a pressure pad unit 24 and a ram unit 25, which typically move in a vertical direction within the press 20. Wear plates 24*a*, 25*a* may be provided along adjacent moving surfaces of the pressure pad unit 24 and the ram unit 25 to prevent excessive wear and provide smooth sliding movement. A die set, which is specific to the part or parts being formed, includes a lower die 26 and die post 27 coupled to the lower die shoe 23, and an upper pressure pad unit die 28 with the pressure pad unit 24. Generally, the lower die 26 and the die post 27 are formed as a single unit, and the upper pressure pad unit die 28 and the pressure pad unit 24 are formed as a single unit. It will be appreciated, however, that the respective components may be formed seperately, and secured together.

During operation, sheet stock made of steel or the like is advanced into position between the lower die 26 and the pressure pad unit 24. The press 20 is then actuated to lower the pressure pad unit 24 to move the upper pressure pad unit die 28 toward the lower die 26. As the upper pressure pad unit die 28 approaches the lower die 26, the stock may be progressively deformed between the die halves 28, 26. While, in transfer presses, the upper pressure pad unit 24 generally makes only a single hit, it will be appreciated that the invention may likewise be utilized in a press that makes multiple hits, depending upon the stock utilized and the design of the part into which the stock is being formed, as well as the specifications of the press 20 itself.

Figure 7:
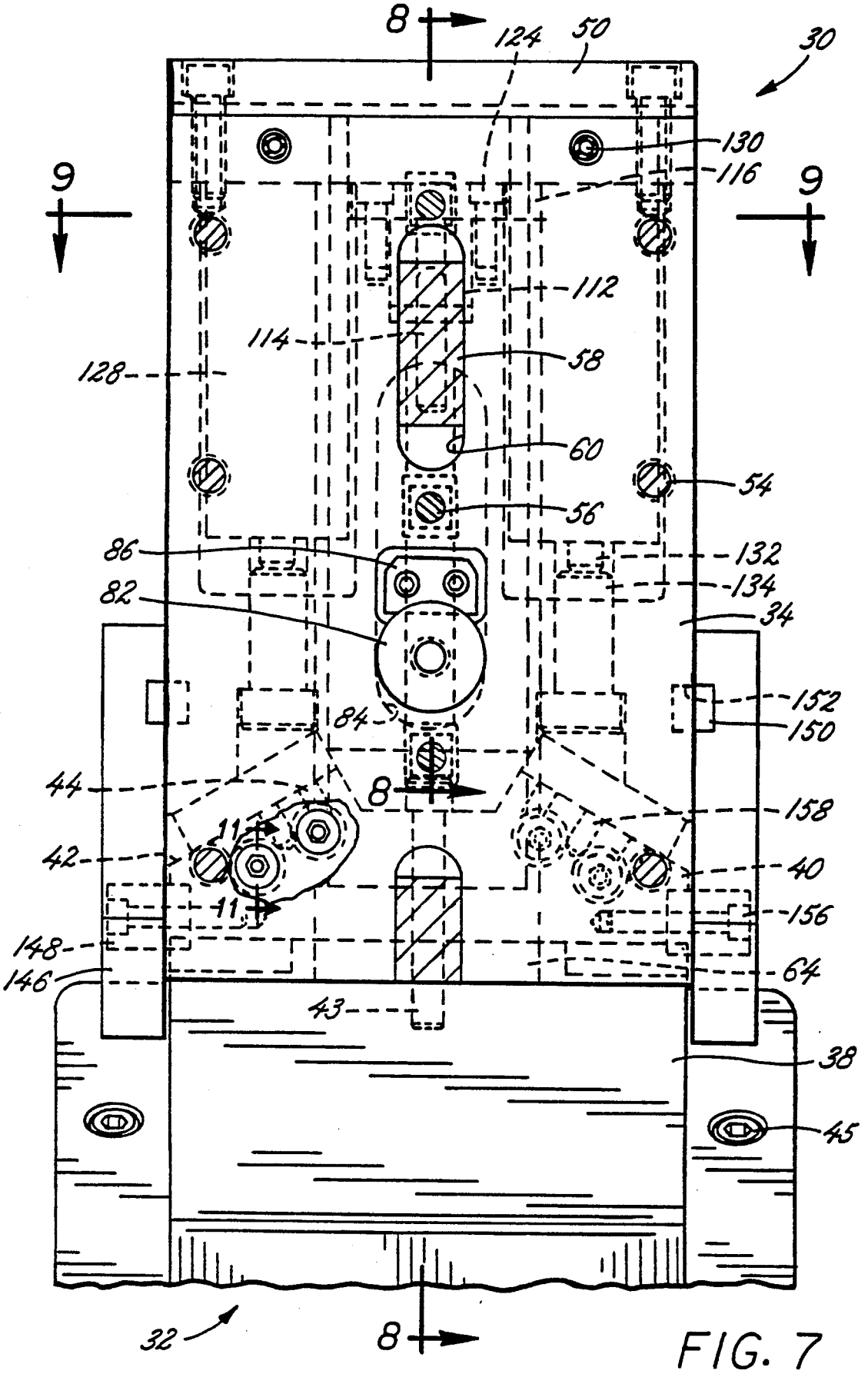
FIG. 7 is an enlarged view of the aerial cam assembly taken along line 7—7 in FIG. 4.

In accordance with the invention, there is provided an aerial cam unit 30 for performing additional operations such as cutting, punching, folding, and flanging, on the workpiece. Although the unit 30 and its operation will be described with reference to a press 20 in which the pressure pad unit 24 and the ram 25 unit move in a vertical direction, the invention is likewise applicable to a press wherein the pressure pad unit and the ram move at some angle to the vertical. The aerial cam unit 30, which is shown in greater detail in FIG. 2, comprises a driver assembly 32 and a slide block 34 to which a tool 36 is secured for performing a desired operation on the workpiece. While the invention will be explained with reference to a cutter used for trimming operations, it will be appreciated that a punch or other tool would likewise be suitable. While the specific design of the driver assembly may vary, in the embodiment shown, the driver assembly 32 includes a driver base 38 to which is secured a driver block 40 having an upper inclined bearing surface 42, the driver block 40 being secured to the driver base 38 by bolts 43. The driver base 38 is mounted to the lower die shoe 23 by bolts 45 to prevent relative movement (as shown in FIGS. 1 and 7).

According to another aspect of the invention, the slide block 34 includes an inclined lower surface 44, which is disposed parallel to the inclined upper surface 42 of the driver assembly 32. It will be appreciated that the upper inclined surface 42 of the driver assembly 32 and the lower inclined surface 44 of the slide block 34 may be of any appropriate design and angle $\phi$, so long as the surfaces remain substantially parallel In the preferred embodiment, the inclined surfaces 42, 44 are of a substantially inverted U-shape, disposed at approximately a 30° angle to the horizontal plane. Preferably, the die designer chooses the angle $\phi$ of the driver assembly 32 to provide a substantially perpendicular motion of the cutting steel or tool 36 relative to the die 26 and die post 27, as the slide block 34 moves relative to the ram 25, as explained below.

The slide block 34 is coupled to the ram unit 25 for vertical movement therewith so that as the ram unit 25 is lowered, the slide block 34 is likewise lowered toward the driver assembly 32. According to an important aspect of the invention, the slide block 34 is disposed in a plane at an angle to the vertical and is mounted to slide at an angle to the vertical within that plane between an uppermost position and a lowermost position. For the purposes of explanation, the uppermost position of the block 34, i.e. nearest to the ram 25 may be identified as the retracted position, while the lowermost position, i.e. most distant from the ram 25, may be identified as the extended position It will be appreciated that when the press 20 is open, the slide block 34 will generally be disposed in the extended position due to the force of gravity and the nitrogen-filled cylinders 128 (as will be explained in greater detail below), as substantially shown in FIG. 3. Conversely, when the ram 25 is in its lowermost position and the slide block 34 is caused to move toward the ram 25, the slide block 34 will generally be disposed in its retracted position, as substantially shown in FIG. 6.

Figure 3:
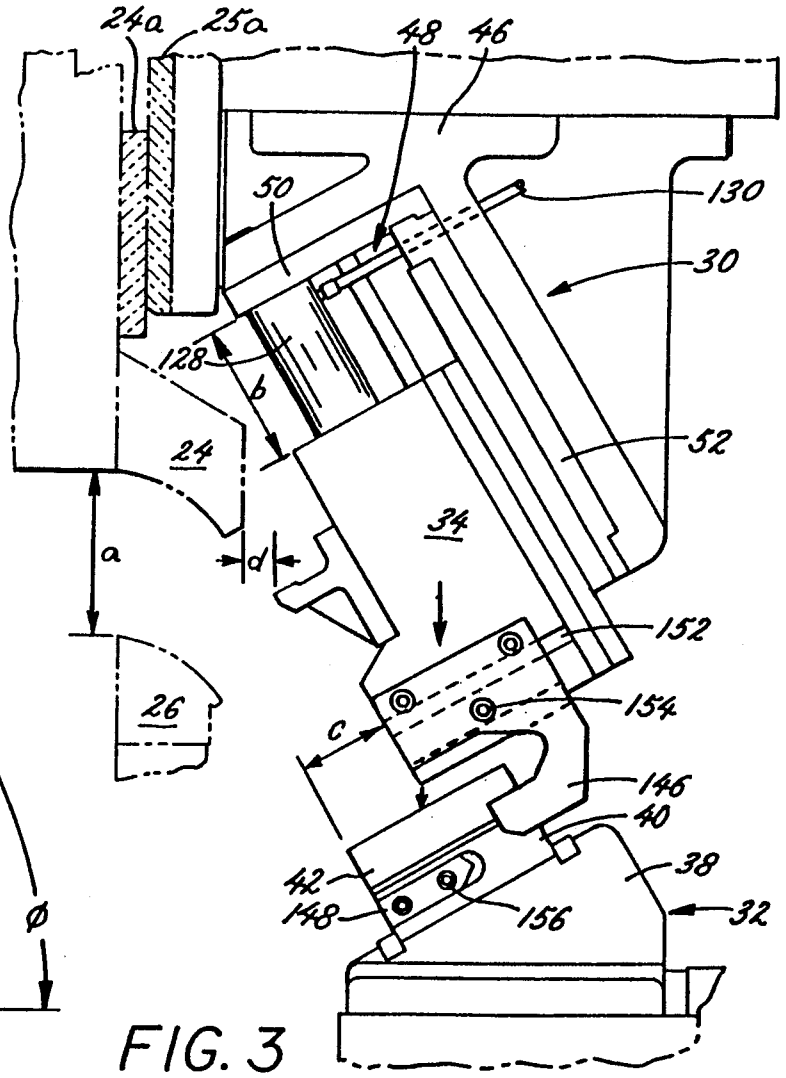
FIGS. 3–6 are fragmentary side views of the power press of FIG. 1 showing the ram progressing in the downward direction.
Figure 4:
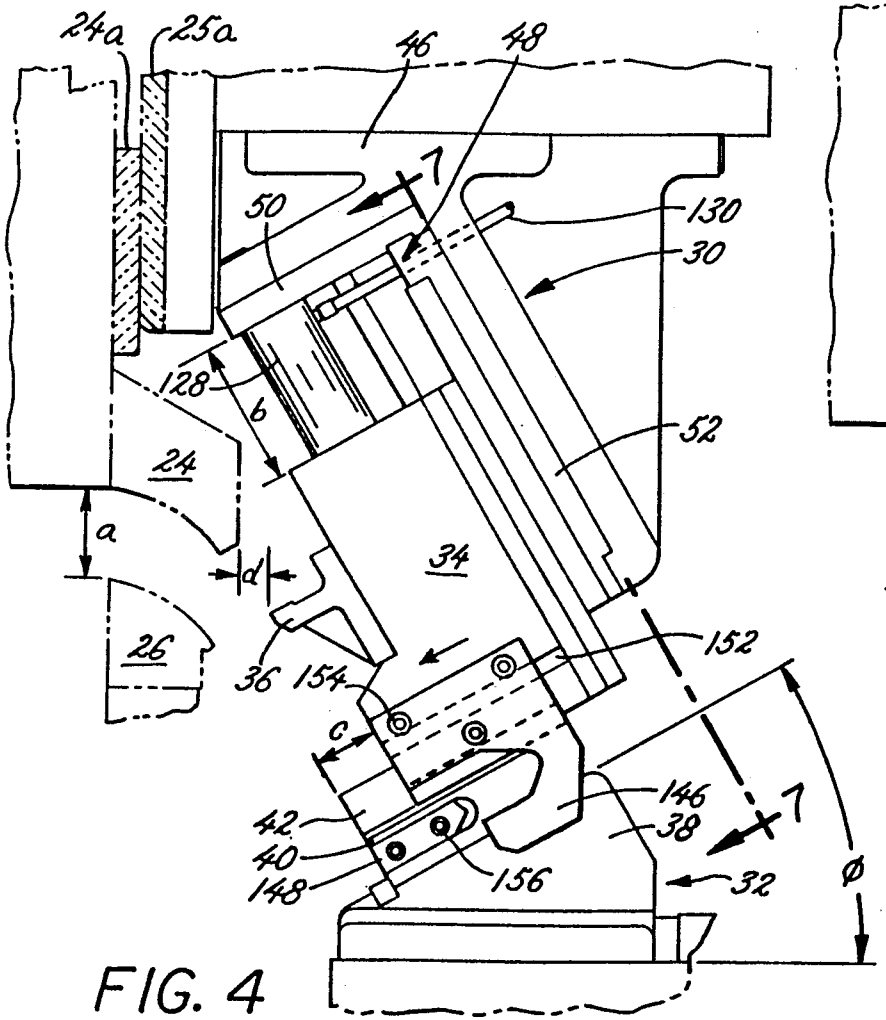
Figure 5:
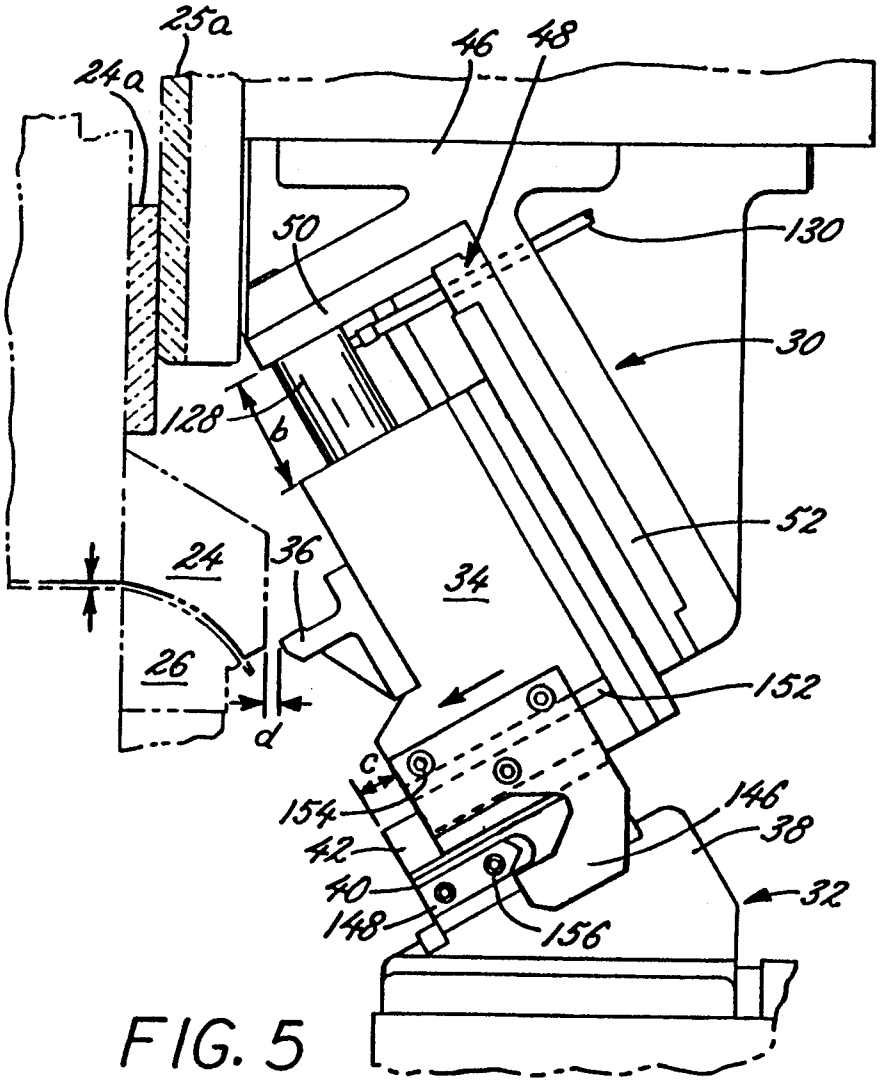
Figure 6:
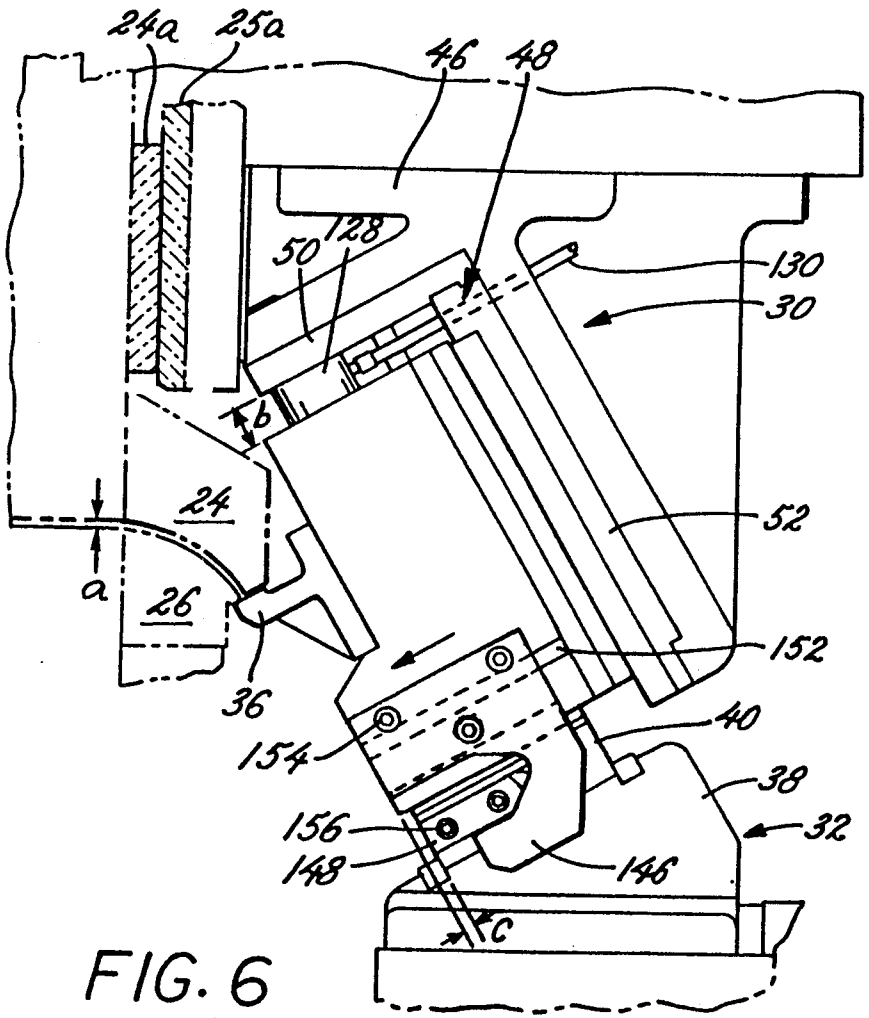

As shown in FIGS. 3–6, as the ram unit 25 and the pressure pad unit 24 lower during operation (distance "a" decreases), the pressure pad unit 24 is compressed against the lower die 26 and die post 27 to perform an operation on the stock, or merely hold the stock in place. Further, as the ram unit 25 is lowered, the slide block 34 is lowered therewith. As the slide block 34 is lowered, the inclined lower surface 44 of the slide block 34 contacts the upper inclined surface 42 of the driver assembly 32 (as shown in FIGS. 3 and 4). As the ram unit 25 proceeds downward, slide block 34 slides upward relative to the ram unit 25 as the inclined lower surface 44 of the slide block 34 slides downward along the inclined upper surface 42 of the driver assembly 32 (distances "b" and "c" decrease, as shown in FIGS. 4–6).

Inasmuch as the slide block 34 is slidably mounted at an angle to the plane of movement of the ram unit 25, the upward sliding movement of the slide block 34 will have both a component substantially parallel to the movement of the ram unit 25 and a component substantially transverse to the movement of the ram unit 25. Thus, as the slide block 34 slides upward relative to the ram unit 25, it likewise slides inward toward the workpiece situated between the pressure pad unit 24 and the lower die post 27 to perform the desired operation on the workpiece (distance "d" decreases).

On the return stroke, as the ram unit 25 moves upward in the press 20, slide block 34 slides downward relative to the ram unit 25 (distance "b" increases), and the inclined lower surface 44 of the slide block 34 slides upward and outward on the inclined upper surface 42 of the driver assembly 32 (distance "c" increasing) to disengage the tool 36 from the workpiece (distance "d" increasing). As the ram unit 25 continues in the upward direction, the slide block 34 separates from the driver assembly 32. Thus, it will be appreciated that the aerial cam unit 30 will not interfere with movement of the workpieces and stock through the press 20 itself as it provides ample room for any transfer mechanisms to operate freely and without cam interference.

Returning now to FIG. 2, the slide block 34 is mounted to the ram unit 25 by means of an L-shaped upper mounting bracket 46, which is secured to the ram unit 25 for movement therewith. In order to couple the slide block 34 to the mounting bracket 46, the aerial cam unit 30 is provided with a mating L-shaped back plate 48. In the exemplified embodiment, the back plate 48 is formed of two mating components, a top plate 50 and a rear plate 52, and is secured to the mounting bracket 46 by means of bolts 54, 56 (shown in detail in FIGS. 7–9).

Figure 8:
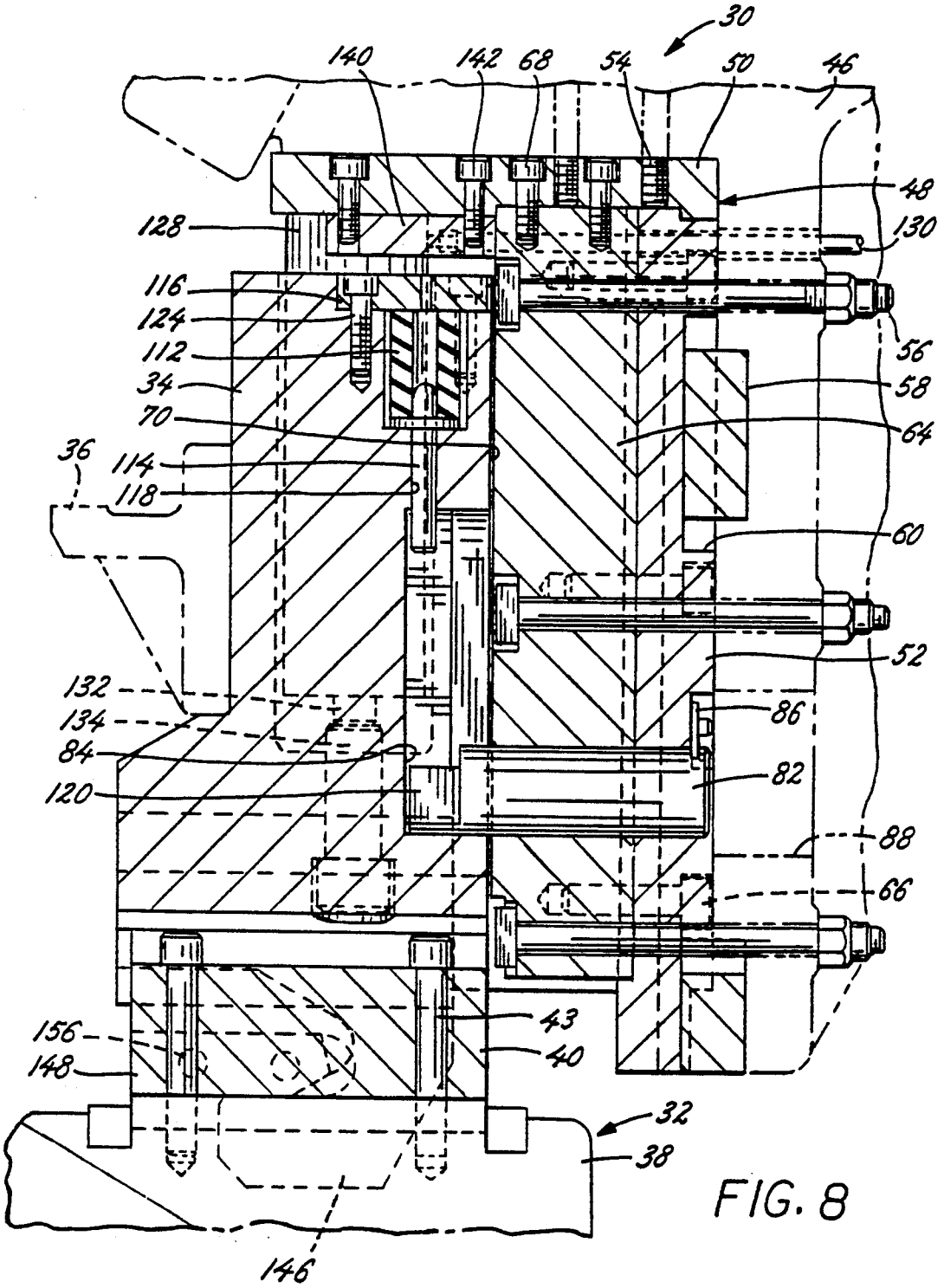
FIG. 8 is a cross-sectional view of the aerial cam unit taken along line 8—8 in FIG. 7.
Figure 9:
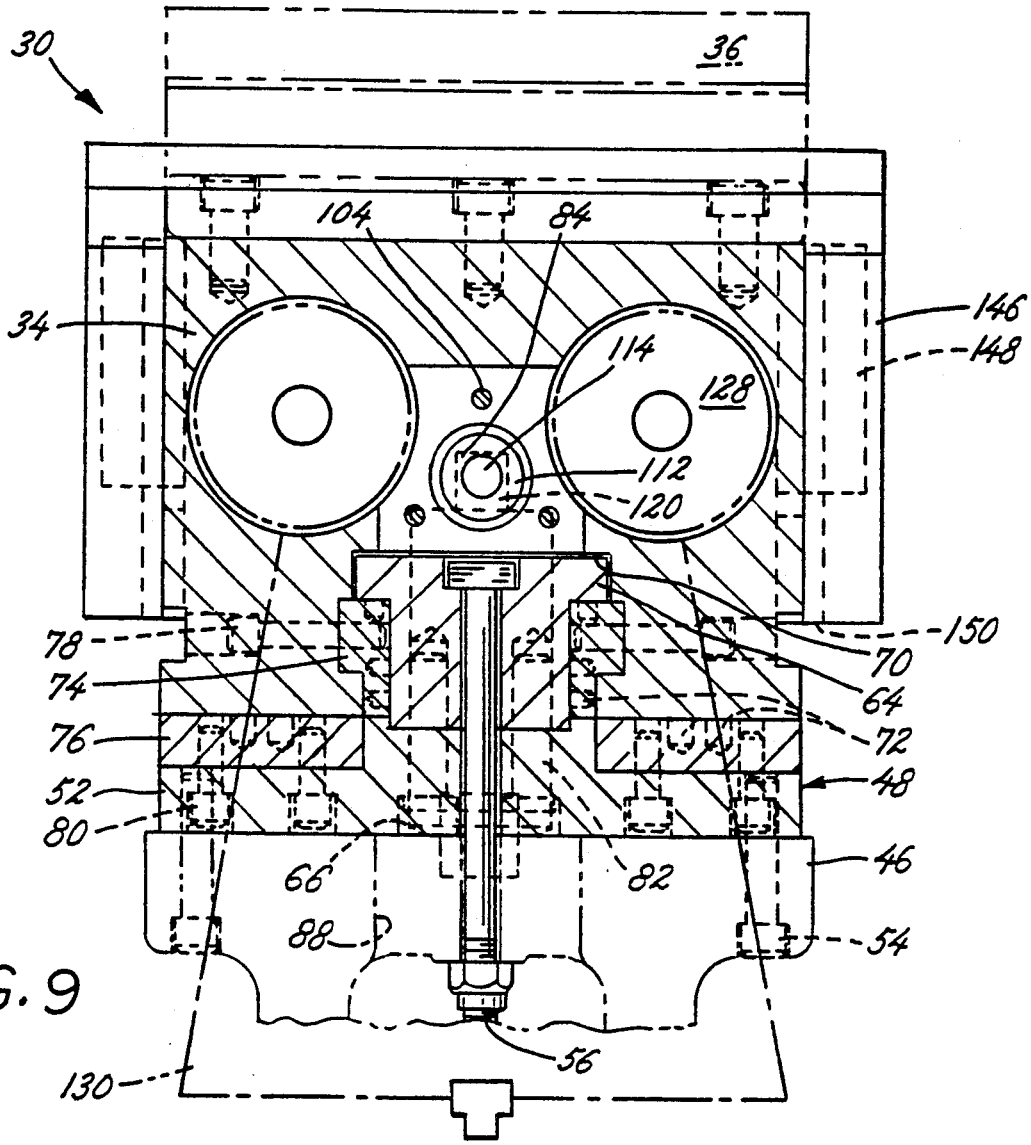
FIG. 9 is a cross-sectional view of the aerial cam unit taken along line 9—9 in FIG. 7.

In order to assist in positioning the back plate 48 on the mounting bracket 46 and securing the components together, the mounting bracket 46 is provided with an elongated key 58 and the back plate 48 provided with a corresponding keyway 60 (shown in detail in FIGS. 7–9). During assembly, the keyway 60 of the back plate 48 is positioned over the key 58 extending outward from the bracket 46. The safety through bolts 56 and bolts 54 are then inserted through the provided bores and tightened to secure the back plate 48 (and the T-gib, as explained below) to the bracket 46. It will thus be appreciated that back plate 48 may be easily assembled to and removed from the upper mounting bracket 46.

In the embodiment shown, the slide block 34 is slidably coupled to the back plate 48 and, therefore, the ram unit 25 by means of a T-gib assembly. As best seen in FIGS. 7–9, the T-gib assembly includes an elongated T-gib 64 which is secured to the rear plate 52 by bolts 66 and the top plate 50 by means of bolts 68. (It will be appreciated that safety through bolts 56 are assembled through the T-gib 64 and the rear plate 52 when mounted to the mounting bracket 46.) As best seen in FIG. 9, the slide block 34 is formed with a mating opening 70 to provide sliding movement of the slide block 34 along the T-gib 64.

In order to provide for smooth sliding of the components, lubrication is provided to the mating surfaces by means of solid lubricant plugs 72 disposed in replaceable insets 74, 76 in both the slide block 34 and the rear plate 52, respectively (shown in FIG. 9). In the preferred embodiment, the plugs 72 are fabricated from a graphite material. It will be appreciated, however, that the plugs 72 could be fabricated from another appropriate material, or lubrication may be provided by an alternate means if so desired. As shown in FIG. 9, the insets 74 are secured to the slide block 34 by means of bolts 78 and the insets 76 secured to the back plate 52 by bolts 80. Thus, it will be appreciated by those skilled in the art that the coupling means, i.e. the sliding components of the slide block 34 and rear plate 52, may be easily replaced or adjusted.

In order to limit the sliding movement of the slide block 34 along the T-gib 64, a stop pin 82 is provided. In the embodiment shown, the stop pin 82 is secured to the rear plate 52 and the T-gib 64 and extends into an elongated opening 84 in the slide block 34. In this way, the stop pin 82 limits the sliding movement of the slide block 34 to define the extended position of the slide block 34 when the slide block 34 is in the extreme downward position.

According to an aspect of the invention, the stop pin 82 may be easily replaced. The stop pin 82 is secured to the rear plate 52 and the T-gib 64 by a retaining plate 86. In order to provide easy access to the retaining plate 86 and stop pin 82, the mounting bracket 46 is provided with an access opening 88, as shown in FIG. 1. In this way, the stop pin 82 may be removed to permit the slide block 34 to be slid downward on the T-gib 64 and removed for clearance adjustment or other maintenance while the die is in the press 20.

Figure 12:
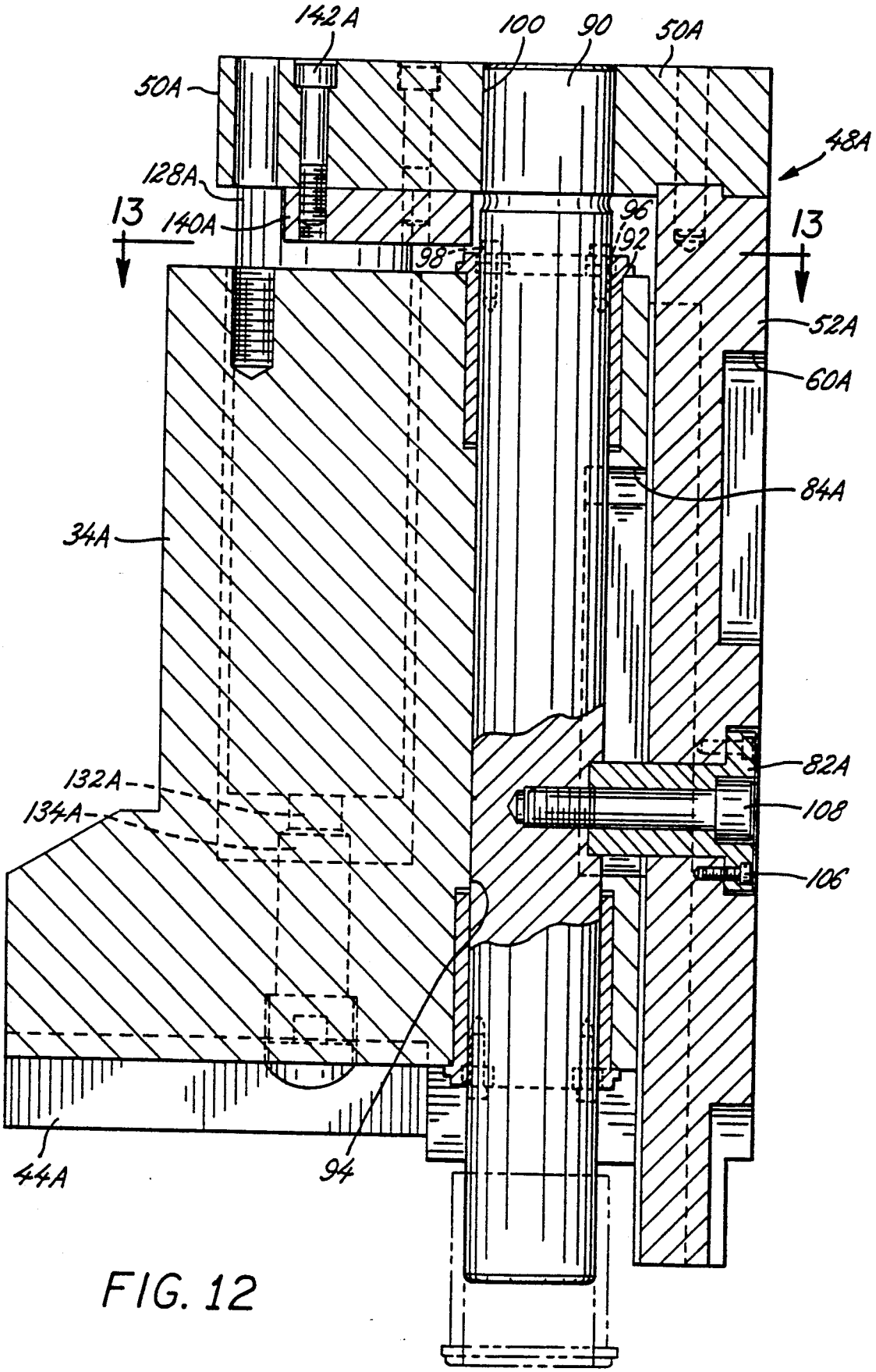
FIG. 12 is a cross-sectional side view of an alternate embodiment of the invention.
Figure 13:
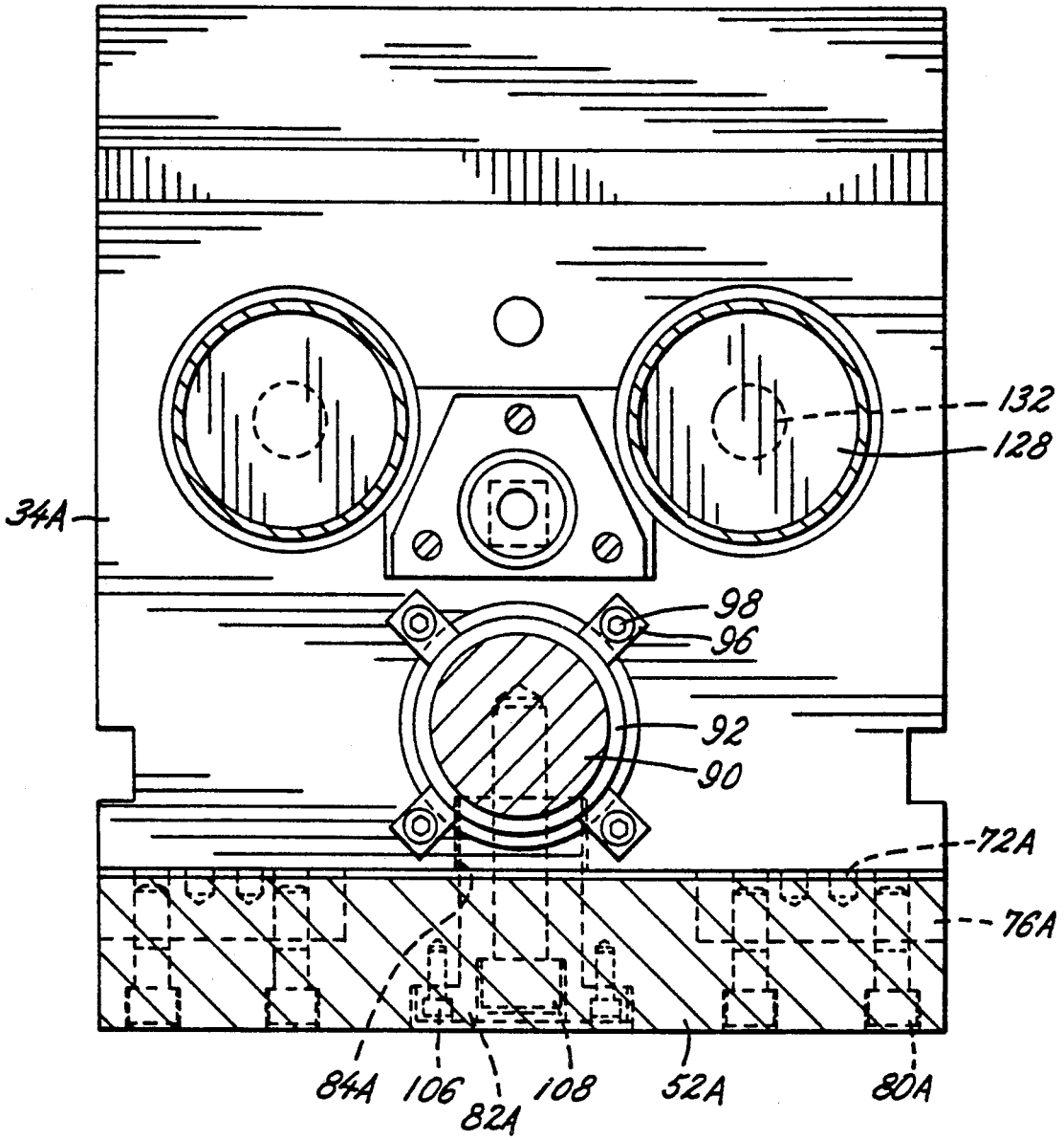
FIG. 13 is a cross-sectional view of the aerial cam unit taken along line 13—13 in FIG. 12.

Although the preferred embodiment utilizes T-gib to slidably couple the slide block to the back plate, it will be appreciated that the units could be slidably coupled by any alternate appropriate means. For example, a guide pin 90 and slide bushing 92 arrangement could likewise be utilized, as shown in FIGS. 12 and 13. (The components of the device shown in FIGS. 12 and 13 have been designated with the same numbers as those utilized in the preferred embodiment followed by the letter "A".) In order to provide the sliding movement, the slide block 34A is provided with an internal bore 94 through which the guide pin 90 is slidably disposed; the guide pin 90 is secured to the back plate 48A.

In order to provide smooth sliding movement of the slide block 34A along the guide pin 90, slide bushings 92 are provided at the upper and lower ends of the internal bore 94. While a suitable lubricant may be provided between the bushings 92 and the internal bore 94, the bushings 92 are preferably fabricated from a low friction material, such as aluminum-bronze. In the embodiment shown, the bushings 92 are coupled to the slide block 34A by bushing clamps 96, which are secured to the slide block 34A by screws 98.

In order to secure the guide pin 90 to the back plate 48A, an opening 100 is provided in the top plate 50A, into which the guide pin 90 is inserted; also provided is a stop pin 82A, which serves the functions of both further securing the guide pin 90 to the rear plate 52A and limiting the sliding movement of the slide block 34A. The stop pin 82A is secured to the rear plate 52A by screws 106, and to the guide pin 90 by screw 108. In order to limit the travel of the slide block 34A and define the extended and retracted positions of the slide block 34A, an elongated opening 84A is provided in the slide block 34A. It will thus be appreciated that the sliding movement of the slide block 34A may be defined by the guide pin 90 and slide bushings 92 and related components as described above.

Figure 10:
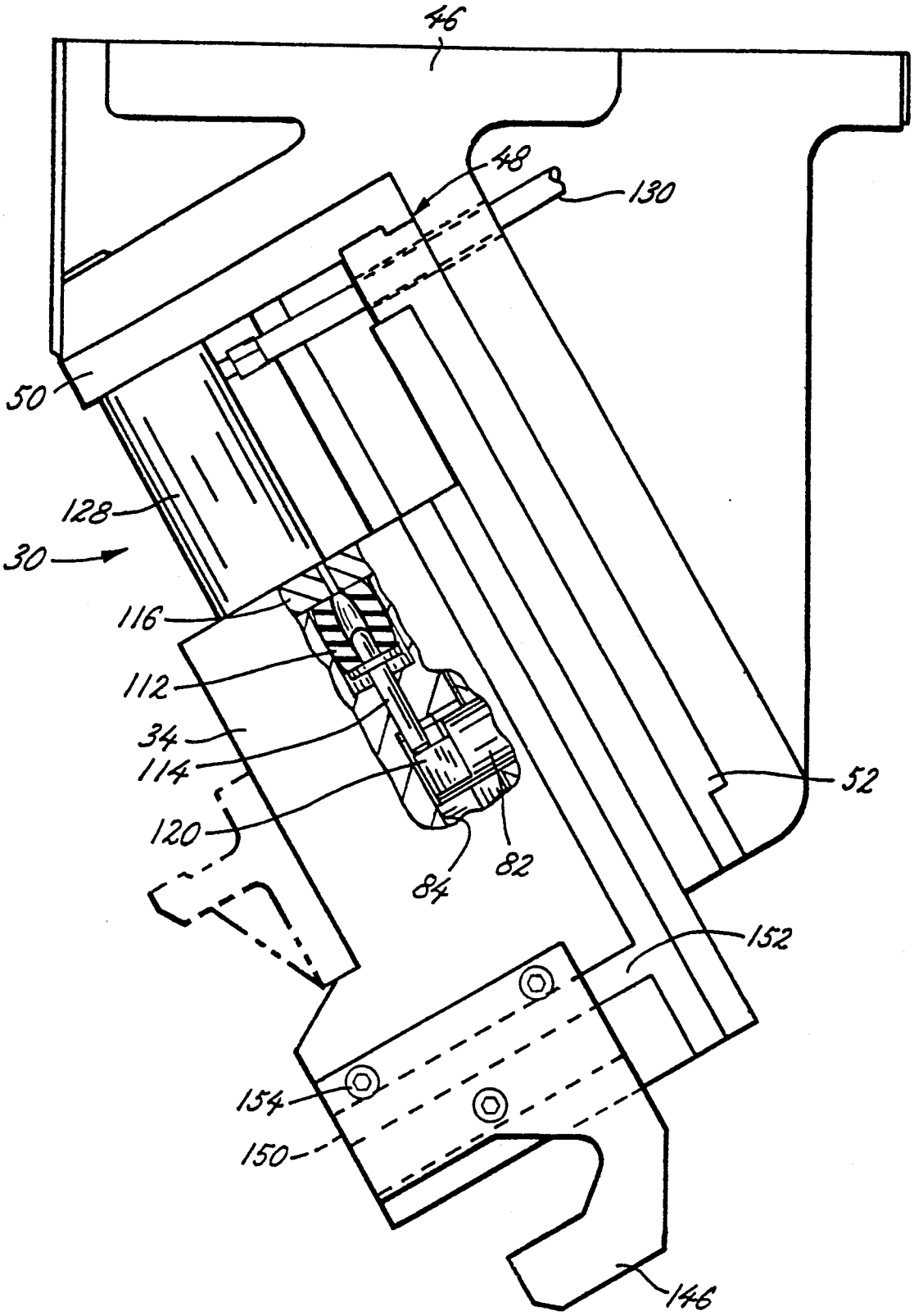
FIG. 10 is a side view of the aerial cam unit in the extreme downward position with cut away to show the relative position of the shock absorbing spring.

Returning now to the preferred embodiment of the invention as shown in FIGS. 7–9, in order to further control the movement of the slide block 34 from the retracted to the extended position, and to reduce noise associated with the movement of the slide block 34, the invention provides a damping device. In the embodiment illustrated in FIGS. 7–9, the device comprises a tubular-shaped elastomeric spring 112. However, it will be appreciated that other shapes or damping devices (for example, a coil spring) may likewise be utilized. The currently preferred embodiment utilizes a fabric coating rubber spring such as the Marsh Mellow TM spring manufactured by the Firestone Tire & Rubber Co. The tubular-shaped spring 112 is disposed between a movable disk pin 114 along its lower surface and a stop plate 116 along its upper surface. The disk pin 114 is disposed within a bore 118, which opens into the elongated channel 84. In this way, as the slide block 34 moves from the retracted position (shown in FIG. 8) to the extended position (shown in FIG. 10), the stop pin 82 moves upward relative to the elongated channel 84 to rest and push against the disk pin 114 to compress the spring 112. In this way, the movement of the slide block 34 from the retracted position to the extended position is substantially dampened and noise associated with the movement is minimized as the spring 112 is compressed.

As best seen in FIGS. 8 and 9, the end of the stop pin 82 may be flattened along its upper surface to ensure a slip-free engagement of the disk pin 114 with the stop pin 82. In the preferred embodiment, the end 120 of the stop pin 82 is formed as a rectangle, and the elongated channel 84 is formed with a corresponding elongated rectangular portion in which the end 120 of the stop pin 82 rides. It will be appreciated that the damping characteristics of the slide block 34 may be adjusted slightly by removing material from the upper surface of the end 120 of the stop pin 82.

As shown in FIGS. 7 and 8, the stop plate 116 that abuts the upper surface of the spring 112 is disposed in the upper surface of the slide block 34 and secured by bolts 124. Thus, it will be appreciated that the spring 112 may be easily replaced by simply removing the bolts 124 and stop plate 116. Removal of this stop plate 116 likewise provides easy access to the disk pin 114 for replacement or adjustment. In this way, the total damping distance travelled by the slide block 34, as well as the damping characteristics of the spring 112 as the slide block 34 moves from the retracted to the extended position may be easily modified and tailored to particular requirements within the limits of the range of travel. Similarly, the total travel of the slide block 34 may be increased by removing material from the slide block 34 to extend the length of the slot 84.

Similarly, in order to control the movement of the slide block 34 from the extended to the retracted position and to prevent damage to the die due to transient bounce, a second damping means is provided. It will be appreciated that sufficient damping force is required to prevent any transient bounce of the slide block 34 when it first contacts the driver assembly 32. In the exemplified embodiment, two parallel nitrogen-filled cylinders 128 are provided. The nitrogen cylinders 128 shown are of a conventional design having a nitrogen-filled chamber defined by the inner wall of the cylinder and a piston (not shown). The nitrogen cylinders 128 may be charged through nitrogen hoses 130 to attain a desired damping coefficient. (It will be appreciated by those skilled in the art that the nitrogen cylinders should be discharged before disassembling the aerial cam unit 30.) Piston rods 132 coupled to the respective pistons extend downward from each nitrogen cylinder and abut upwardly extending stops 134. In the preferred embodiment, the stops 134 are adjustable and replaceable. Consequently, the stops 134 may be adjusted to account for wear or to slightly modify the retracted position of the slide block 34.

Figure 14:
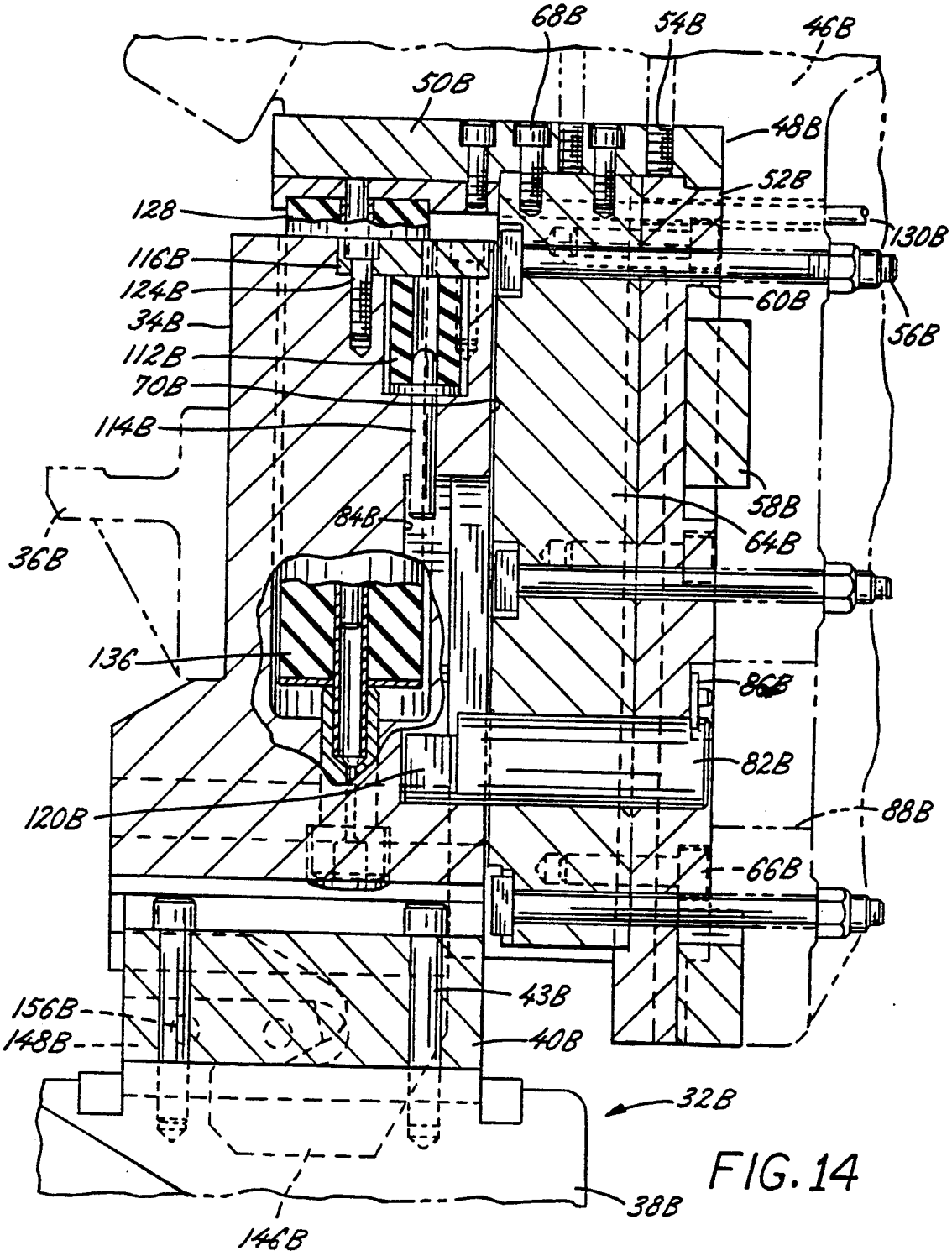
FIG. 14 is a cross-sectional side view of an alternate embodiment of the invention partially cut away to show springs.

It will, however, be appreciated that one or more alternate damping devices could be utilized. As shown in FIG. 14, springs 136, similar to the spring 112 that controls movement of the slide block 34 from the retracted to the extended position, or the like may alternately be utilized. (The components of the device shown in FIG. 14 have been designated with the same numbers as those utilized in the preferred embodiment followed by the letter "B".) For example, one or more coil springs or alternately shaped elastomeric springs could be incorporated (not illustrated).

Returning now to the embodiment shown in FIGS. 7–10, it will be seen that the extreme upward position of the slide block 34 is limited by a stop block 140, which is coupled to the top plate 50 by screws 142. Thus, it will be appreciated that the stop block 140 protects the nitrogen cylinders 128 as well as the hoses 130 from damage.

While the slide block 34 will ordinarily move from the retracted to the extended position due to the force of gravity and the force exerted by the compressed nitrogen in the nitrogen cylinders 128 or alternate damping device as the ram unit 25 moves upward, heavy damage could result to the tool 36 and aerial cam unit 30, as well as the lower die 26 and die post 27, and pressure pad unit 24, and other associated components of the press 20 should the slide block 34 become jammed in the retracted position. Consequently, to ensure that the slide block 34 returns to the extended position as the ram unit 25 moves upward, the invention provides a safety return mechanism. Safety return hooks 146 are provided along the sides of the slide block 34, extending downward from the block toward the driver assembly 32. As best seen in FIGS. 3–6, the safety return hooks 146 engage stripper guide blocks 148 disposed at the angle $\phi$ along the sides of the driver block 40 as the ram unit 25 moves downward within the press 20 and the inclined lower surface 44 of the slide block 34 slides downward across the upper inclined surface 42 of the driver assembly 32. If for some reason the slide block 34 does not return to its extended position on the upward stroke of the ram unit 25, thereby disengaging the tool 36 from the workpiece, the stripper guide blocks 148 will exert a relative downward force on the hooks 146 to move the slide block 34 from the retracted to the extended position and disengage the tool 36 from the workpiece. Those skilled in the art will thus appreciate that the positive safety return mechanism will prevent unnecessary damage to the tool 36 as well as the other components of the aerial cam unit 30 and the power press 20.

The hooks 146 are located on the slide block 34 by keys 150 disposed in keyways 152. As with other components of the aerial cam unit 30, the hooks 146 and stripper guide blocks 148 are likewise secured to the slide block 34 and driver block 40 by bolts 154, 156, respectively. Consequently, these components may likewise be easily replaced or adjusted to account for wear or to modify the design.

As most easily seen in FIGS. 7-9, the bolts that secure the components of the aerial cam unit 30 together are counter sunk to provide a smooth surface above each bolt. It will thus be appreciated that the bolts do not interfere with assembly or mounting of the unit 30, and cannot work loose during operation.

Figure 11:
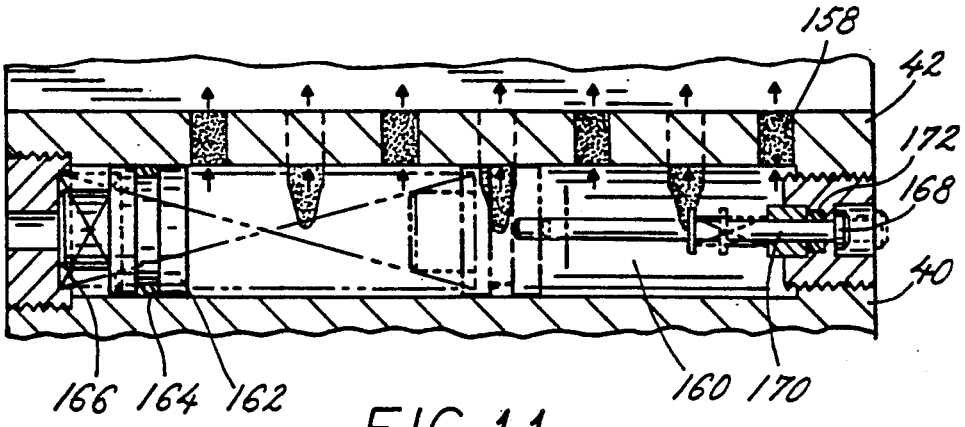
FIG. 11 is an enlarged fragmentary view of a lubrication unit taken along line 11—11 in FIG. 7.

As an additional feature of the invention, the wear surfaces between the inclined upper surface 42 of the driver assembly 32 and the inclined lower surface 44 of the slide block 34 are provided with a lubricant. In the preferred embodiment, solid lubricant plugs 158 are provided along the upper inclined surface 42 of the driver (shown in FIGS. 7 and 11). As with the plugs 72 between the mating surfaces of the slide block 34 and the T-gib 64 and back plate 52, the plugs 158 may be composed of a solid lubricant graphite or another appropriate material. As shown in FIG. 11, the plugs 158 may be provided with a liquid lubricant, such as oil, from an internal well 160.

So that an operator may easily determine whether the well 160 contains sufficient oil to provide a well lubricated surface, the invention provides means for monitoring the level of lubricant contained in the well 160. A piston 162 is disposed within the well 160 and sealed by an O-ring 164. A spring 166 (represented by a solid "X" in FIG. 11) biases the piston 162 toward the lubricant contained in the well 160. Further included in the monitoring device is an indicator button 168 and rod 170, which is sealed by an O-ring 172. As the level of lubricant contained in the well 160 decreases, the spring 166 moves the piston 162 within the well 160 to approach the position indicated by the phantom lines. When the oil reaches a sufficiently low level, the piston 162 exerts a force on the rod 170 to move the rod 170 and button 168 to the position represented by the dotted lines, extending beyond the outer surface of the driver block 40. Thus, when the operator observes the button 168 extending beyond the outer surface of the driver block 40, lubricant may be added to the well 160 to restore it to a desired level and the button 168 and rod 170 may be pressed inward to restore the indicator to a reset position.

Figure 15:
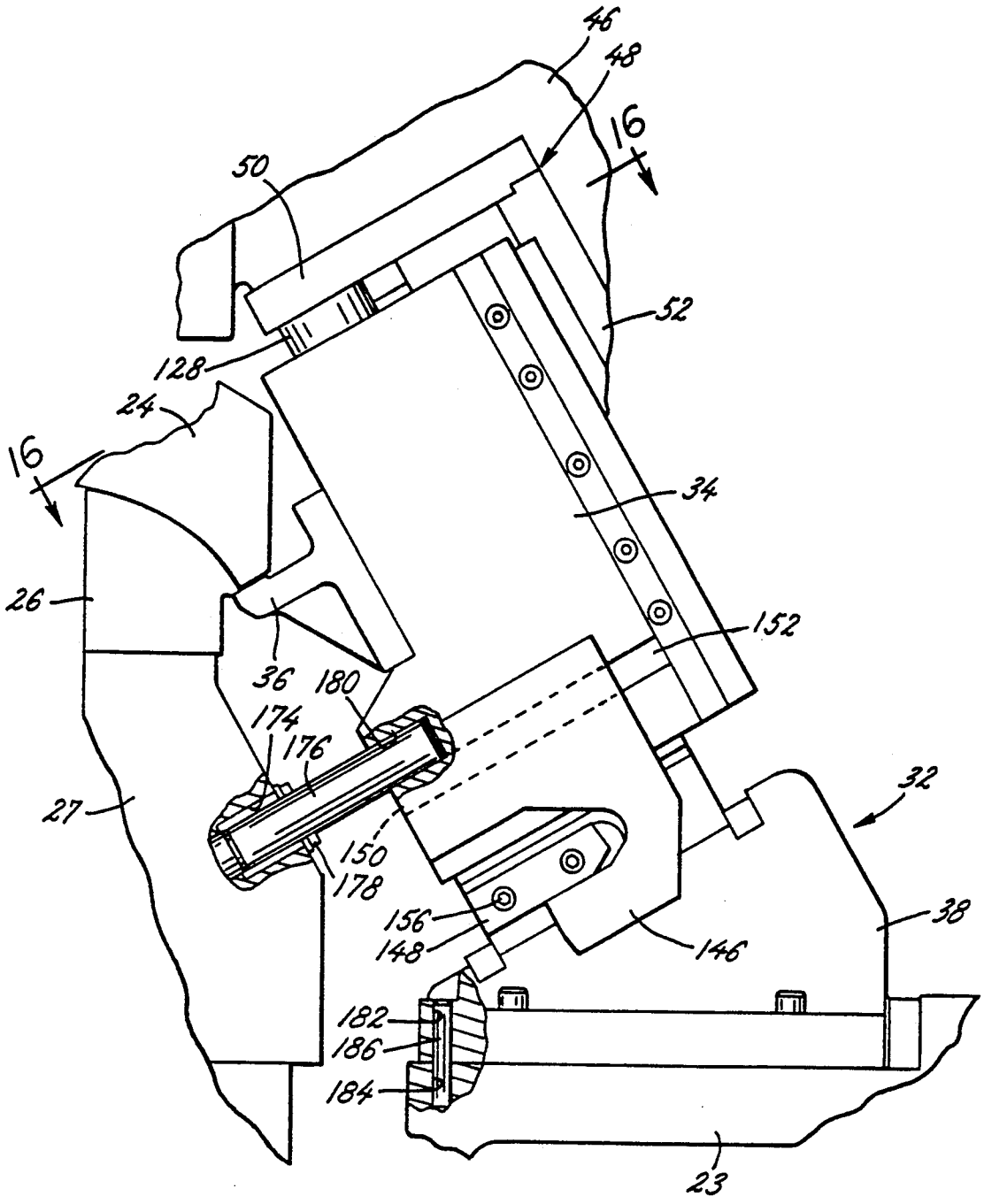
FIG. 15 is a side view of the aerial cam unit cut away to show elements utilized during alignment of a tool.
Figure 16:
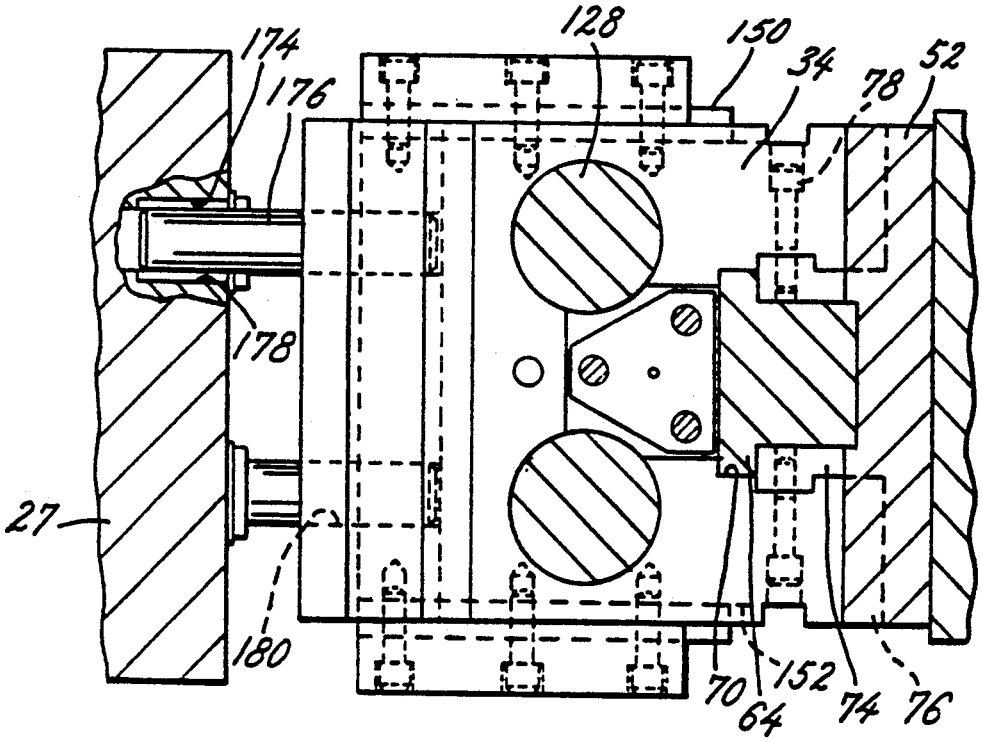
FIG. 16 is a cross-sectional view of the aerial cam unit taken along line 16—16 in FIG. 15.

According to another feature of the invention, the aerial cam unit 30 may be used to facilitate proper alignment of the tool steel 36 for trimming, forming, piercing, and flanging operations. The recommended die setting procedure will be explained with reference to FIGS. 15 and 16.

In order to provide proper alignment of the slide block 34 with the lower die post 27, bushing openings 174 are provided at the correct angle from the travel of the ram 25 in the side surface of the lower die post 27. With the slide block 34 removed from the back plate 48, slide guide pins 176 are inserted into the bushing openings 174. To prevent damage to the lower die post 27 and to prevent the pins 176 from wedging in the bushing openings 174, the bushing openings 174 may be provided with bushings 178 that are located in the post 27 prior to insertion of the pins 176. Corresponding openings 180 in the slide block 34 are then located over and press fitted to the opposite ends of the pins 176. In a preferred embodiment of the invention, two such bushing openings 174 in the post 27, two corresponding openings 180 in the slide block 34, and two pins 176 are provided so that the slide block 34 will be steady, and proper alignment may be achieved. Once the slide block 34 has been properly located, appropriate shim stock may be used to locate the tool 36 such that a desired clearance may be obtained between the tool 36 and the die post 27 to provide accurate operation of the tool 36. A recommended die clearance is on the order of 5% to 10% of the thickness of the material.

With the slide block 34 in position, the driver assembly 32 may be located and secured in its proper position and rigidly attached to the die shoe 23. In order to facilitate proper location of the driver assembly 32 and to steady the driver assembly 32 until it may be bolted down to the lower die shoe 23, one or more openings 182, 184 are provided in the driver assembly 32 and the lower die shoe 23, respectively, into which one or more dowels 186 and one or more threaded fasteners may be inserted. It will thus be appreciated that the aerial cam unit 30 may be easily mounted to provide accurate operation of the tool 36 to provide a desired operation on the workpiece.

Figure 17:
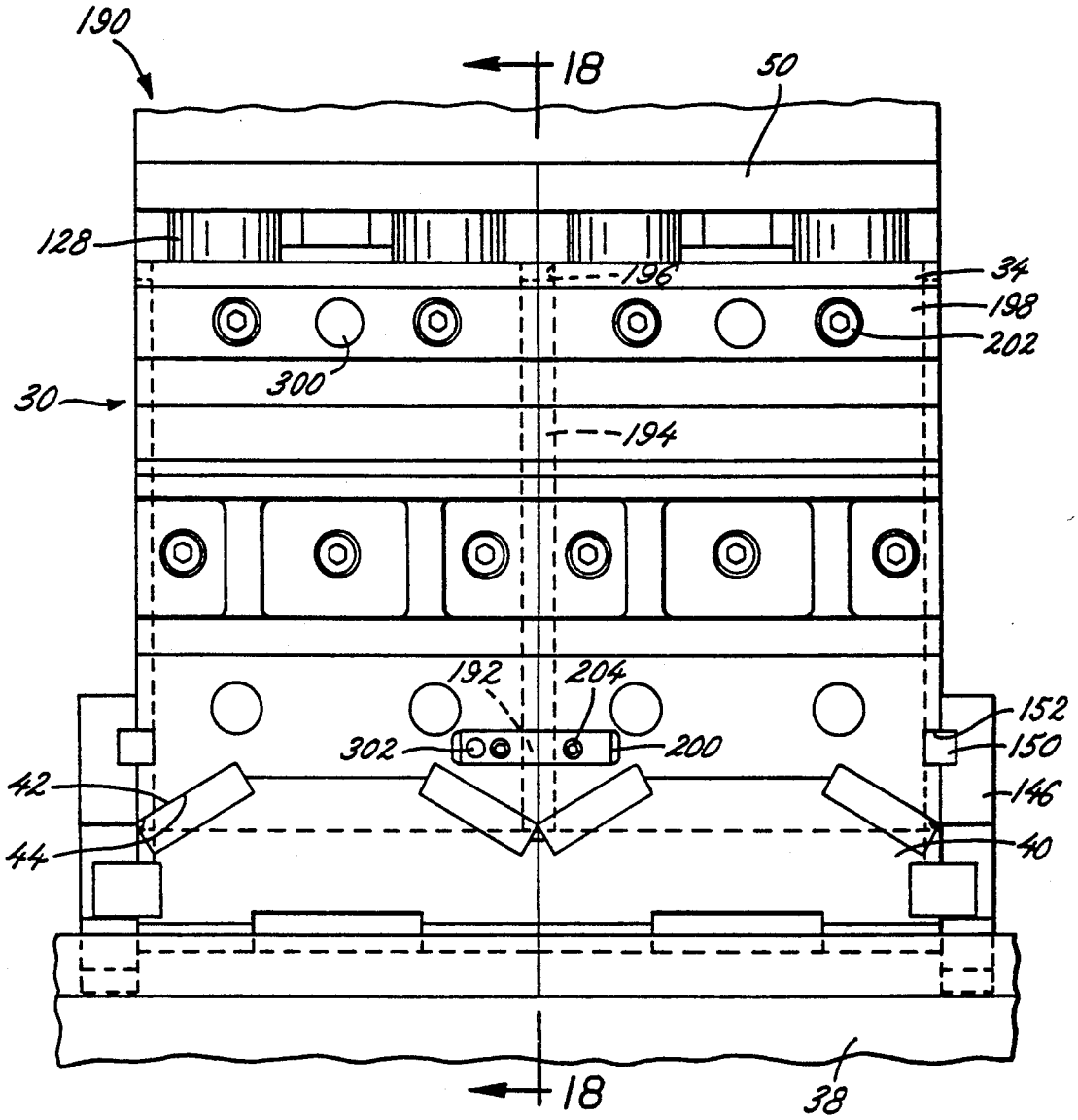
FIG. 17 is a view of a dual mounting of the aerial cam unit.
Figure 18:
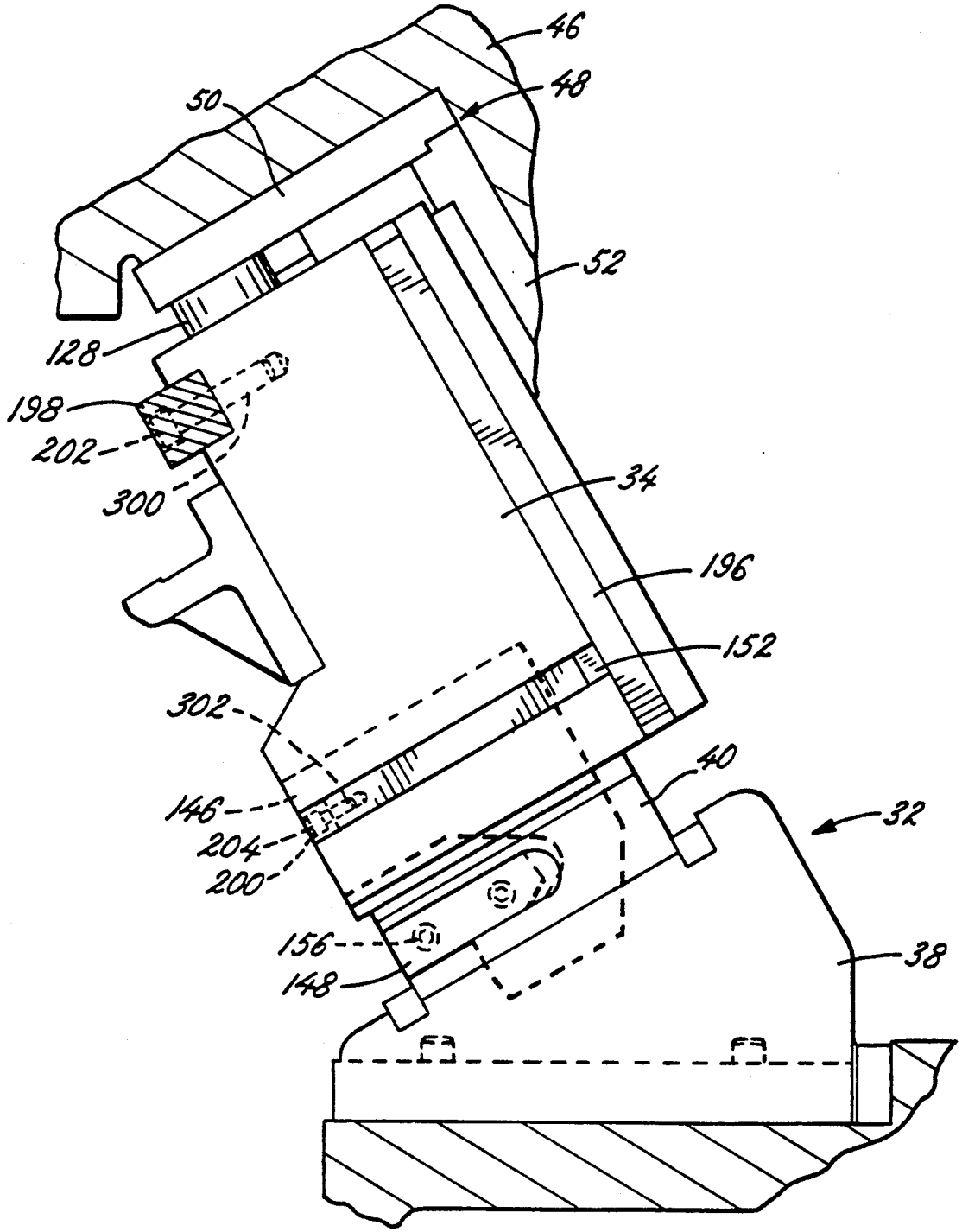
FIG. 18 is a cross-sectional view of the aerial cam unit taken along line 18—18 in FIG. 17.

According to yet another feature of the invention, aerial cam units 30 may additionally be used in groups of two or more for use in applications that require longer trim or form lines. One such grouping is shown in FIGS. 17 and 18 wherein two units 30 are grouped together as a dual unit 190. In order to provide a continual tool edge for performing the trim or form operation, the slide blocks 34 of the individual aerial cam units 30 may be positioned adjacent each other by removing the stripper hooks 146 from adjacently disposed sides of the slide blocks 34. The individual aerial cam units 30 may be precisely aligned together by positioning cross keys 192, 194 in the keyway 152 and the keyway 196, respectively, along adjacent sides of the slide blocks 34. The units 30 may be further secured together by attaching keys 198, 200, which are secured to the units 30 by screws 202, 204, and dowels 300, 302, respectively. In this way, the individual units 30 may be coupled together to move simultaneously to provide longer trim or form operations on the workpiece.

In summary, the invention provides an aerial cam unit 30 that may be easily assembled and disassembled within the press 20 for die setting, maintenance, or modification. In order to disassemble the unit 30, the nitrogen cylinders 128 are first discharged through the nitrogen hoses 130. In order to release the slide block 34, the ram unit 25 is lowered until the slide block 34 moves to its retracted position, sliding along the driver assembly 32. The retaining plate 86 is then removed through the access opening 88, freeing the stop pin 82, which may likewise be removed through the access opening 88. With the stop pin 82 removed, the ram 25 may be moved upward so that the slide block 34 slides off of the T-gib 64. The back plate 48 may then be easily removed from the mounting bracket 46 by removing bolts 54, 56. The driver assembly 32 may likewise be easily removed by removing the bolts 45, which secure it to the press bed 22.

As indicated above, the aerial cam unit 30 comprises numerous components that are independently adjustable and replaceable. Thus, the components of the unit may be easily disassembled and reassembled to modify the unit for use with an alternate die set or to adjust the components to account for wear. It will thus be appreciated that the invention provides a versatile universal unit that standardizes the design of aerial cam units in that the unit may be adapted for use in more than a single application.

I claim as my invention:

1. For use in a power press having a die steel, a pressure pad unit which is movable relative to the die steel to deform or hold a workpiece therebetween, and a ram, an aerial cam assembly for performing an operation on the workpiece, the aerial cam assembly being coupled to the ram for movement therewith and comprising, in combination, a driver having an inclined driver bearing surface, a back plate which is moveable with respect to the driver as the ram is advanced, a slide block having an inclined cam bearing surface, the inclined cam bearing surface disposed substantially parallel to the inclined driver bearing surface, means for slidably coupling the slide block to the back plate to move the slide block between an extended position and a retracted position in a plane disposed at an angle to the plane of said ram movement, such that when the cam bearing surface abuts the driver bearing surface and the back plate moves with respect to the driver within the plane of said ram movement, the cam bearing surface slides along the driver bearing surface and the slide block moves between the extended and the retracted positions, a stop disposed to limit the sliding movement of the slide block and thus define the extended and retracted positions of the slide block, a working tool for performing an operation on the workpiece, the working tool extending from the slide block toward the workpiece such that as the slide block moves from the extended position to the retracted position, the working tool engages the workpiece to perform the operation on the workpiece, whereby as the ram moves to close the die set, the inclined cam bearing surface abuts and slides along the driver bearing surface to move the slide block from the extended to the retracted position causing the working tool to engage and perform the operation upon the workpiece.

2. The aerial cam unit of claim 1, wherein the coupling means comprises a T-gib.

3. The aerial cam unit of claim 1, wherein the coupling means comprises at least one guide pin and at least one slide bushing.

4. The aerial cam unit of claim 1, wherein the stop includes damping means for controlling the travel and transient impact bounce of the slide block from the extended position to the retracted position.

5. The aerial cam unit of claim 4, wherein the damping means comprises at least one compressible gas cylinder.

6. The aerial cam unit of claim 5, wherein the compressible gas is nitrogen.

7. The aerial cam unit of claim 5, wherein the compressible gas is an inert gas.

8. The aerial cam unit of claim 4, wherein the damping means comprises an elastomeric material.

9. The aerial cam unit of claim 4, wherein the damping means comprises at least one coil spring.

10. The aerial cam unit of claim 1, further including damping means for controlling the travel of the slide block from the retracted position to the extended position.

11. The aerial cam unit of claim 10, wherein the damping means comprises an elastomeric material.

12. The aerial cam unit of claim 10, wherein the damping means comprises at least one coil spring.

13. The aerial cam unit of claim 1 further comprising safety means for ensuring that the slide block returns from the retracted position to the extended position.

14. The aerial cam unit of claim 13, wherein the safety means comprises a hook and a cam coupled to the driver and the slide block such that the hook and the cam engage when the slide block is in the retracted position to return the slide block to the extended position when the ram moves to open the die set.

15. The aerial cam unit of claim 1, wherein the distance traveled by the slide block is adjustable.

16. The aerial cam unit of claim 1, wherein the coupling means is adjustable.

17. The aerial cam unit of claim further comprising means for lubricating the bearing surfaces.

18. The aerial cam unit of claim 17, wherein the lubricating means comprises solid lubricant plugs.

19. The aerial cam unit of claim 18, further comprising means for supplying at least a portion of the solid lubricant plugs with a pressurized liquid lubricant.

20. The aerial cam unit of claim 19, further comprising means for indicating the level of lubricant.

21. The aerial cam unit of claim 20, wherein the indicating means includes a spring actuated indicator.

22. The aerial cam unit of claim 1 wherein the stop is retractable to permit removal of the slide block from the back plate.

23. The aerial cam unit of claim 1 further comprising at least one keyway whereby a plurality of aerial cam units may be coupled together.

24. For use in a power press having a die steel, a pressure pad unit which is movable relative to the die steel to deform or hold a workpiece therebetween, and a ram, an aerial cam assembly for performing an operation on the workpiece, the aerial cam assembly being coupled to the ram for movement therewith and comprising a plurality of aerial cam units, at least one such aerial cam unit comprising, in combination, a driver having an inclined driver bearing surface, a back plate which is moveable with respect to the driver as the ram is advanced, a slide block having an inclined cam bearing surface, the inclined cam bearing surface disposed substantially parallel to the inclined driver bearing surface, the slide block including means for coupling a plurality of slide blocks together for synchronous movement, means for slidably coupling the slide block to the back plate to move the slide block between an extended position and a retracted position in a plane disposed at an angle to the plane of said ram movement, such that when the cam bearing surface abuts the driver bearing surface and the back plate moves with respect to the driver within the plane of said ram movement, the cam bearing surface slides along the driver bearing surface and the slide block moves between the extended and the retracted positions, a stop disposed to limit the sliding movement of the slide block and thus define the extended and retracted positions of the slide block, a working tool for performing an operation on the workpiece, the working tool extending from the slide block toward the workpiece such that as the slide block moves from the extended position to the retracted position, the working tool engages the workpiece to perform the operation on the workpiece, whereby as the ram moves to close the die set, the inclined cam bearing surface abuts and slides along the driver bearing surface to move the slide block from the extended to the retracted position causing the working tool to engage and perform the operation upon the workpiece.

* * * * *

UNITED STATES PATENT AND TRADEMARK OFFICE

CERTIFICATE OF CORRECTION

PATENT NO. : 5,269,167

DATED : December 14, 1993

INVENTOR(S) : Gerhart

Figure 2:
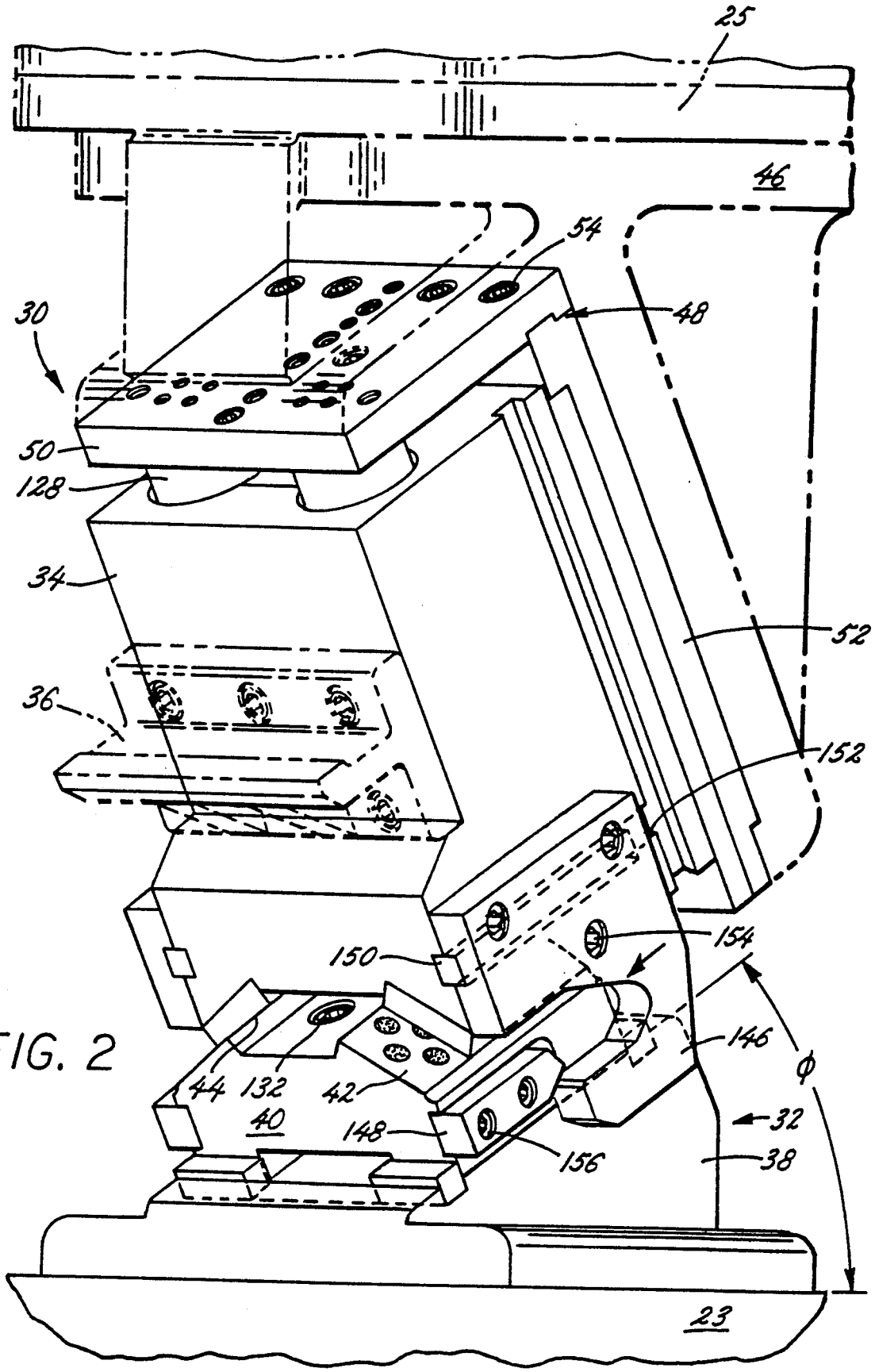
FIG. 2 enlarged perspective view of the aerial cam assembly of FIG. 1.

It is certified that error appears in the above-identified patent and that said Letters Patent is hereby corrected as shown below:

Column 3, line 6, following "Fig. 2" insert -- is an --;

Column 11, line 17, claim 1, delete "a die steel" and substitute therefor -- a die set --;

Column 11, line 18, claim 1, delete "the die steel" and substitute therefor -- the die set --;

Column 12, line 47, claim 24, delete "a die steel" and substitute therefor -- a die set --;

Column 12, line 49-50, claim 24, delete "the die steel" and substitute therefor -- the die set --;

Signed and Sealed this

Eleventh Day of April, 1995

Bruce Lehman

*Attest:*

BRUCE LEHMAN

*Attesting Officer*

*Commissioner of Patents and Trademarks*